US007129856B2

(12) United States Patent
Hering et al.

(10) Patent No.: US 7,129,856 B2
(45) Date of Patent: Oct. 31, 2006

(54) ILLUMINATED SIGN FOR TRAFFIC CONTROL AND METHOD FOR FUNCTIONAL MONITORING OF SUCH A SIGN

(75) Inventors: Bernhard Hering, München (DE); Rudolf Schierjott, München (DE); Gerhard Treffer, Unterhaching (DE)

(73) Assignee: Siemens Aktiengesellschaft, Munich (DE)

( * ) Notice: Subject to any disclaimer, the term of this patent is extended or adjusted under 35 U.S.C. 154(b) by 84 days.

(21) Appl. No.: 10/486,642

(22) PCT Filed: Aug. 5, 2002

(86) PCT No.: PCT/DE02/02877

§ 371 (c)(1),
(2), (4) Date: Feb. 12, 2004

(87) PCT Pub. No.: WO03/017728

PCT Pub. Date: Feb. 27, 2003

(65) Prior Publication Data

US 2004/0201496 A1 Oct. 14, 2004

(30) Foreign Application Priority Data

Aug. 16, 2001 (DE) ..... 101 40 331

(51) Int. Cl.
*G08G 1/095* (2006.01)

(52) U.S. Cl. ..... 340/907; 340/931; 340/331; 340/641; 340/691.8; 340/815.45; 315/200 A; 315/307; 315/309

(58) Field of Classification Search ..... 340/907, 340/931, 641, 642, 660, 664, 691.8, 635, 340/653, 331, 815.45, 652, 815.4; 315/200 A, 315/307, 309, 312
See application file for complete search history.

(56) References Cited

U.S. PATENT DOCUMENTS

| | | | | |
|---|---|---|---|---|
| 5,663,719 | A * | 9/1997 | Deese et al. | 340/912 |
| 6,078,148 | A | 6/2000 | Hochstein | |
| 6,147,617 | A | 11/2000 | Kim | |
| 6,225,912 | B1 | 5/2001 | Mabuchi et al. | |
| 6,265,984 | B1 * | 7/2001 | Molinaroli | 340/815.4 |
| 6,502,956 | B1 * | 1/2003 | Wu | 362/237 |
| 6,583,731 | B1 * | 6/2003 | Chan et al. | 340/931 |

FOREIGN PATENT DOCUMENTS

DE 199 18 336 A1 11/2000

(Continued)

*Primary Examiner*—Hung Nguyen
(74) *Attorney, Agent, or Firm*—Harness, Dickey & Pierce, P.L.C.

(57) ABSTRACT

An illuminated sign is for traffic control, in particular for road traffic, and includes light sources for generation of the sign and a monitoring device for functional monitoring of the light source. The light sources are embodied as light diodes and the monitoring device is embodied as a device for the limited current loading of the light diodes. The functional monitoring of said sign can be achieved with reasonable technical requirements in both the deactivated and activated state thereof.

33 Claims, 2 Drawing Sheets

FOREIGN PATENT DOCUMENTS

| | | |
|---|---|---|
| EP | 0434859 | 7/1991 |
| EP | 0 662 276 B1 | 3/1996 |
| EP | 0 678 078 B1 | 9/1998 |
| EP | 0955619 | 11/1999 |
| FR | 2724749 | 3/1996 |
| HU | 176437 | 2/1981 |
| NL | 1015217 | 1/2001 |
| WO | WO 94/08438 | 4/1994 |
| WO | WO 94/08438 A1 | 4/1994 |
| WO | WO 9408438 | 4/1994 |
| WO | WO 95/12512 A1 | 5/1995 |
| WO | WO 01/01385 A1 | 1/2001 |
| WO | WO 01/46931 A1 | 6/2001 |

* cited by examiner

ILLUMINATED SIGN FOR TRAFFIC CONTROL AND METHOD FOR FUNCTIONAL MONITORING OF SUCH A SIGN

This application is the national phase under 35 U.S.C. § 371 of PCT International Application No. PCT/DE02/02877 which has an International filing date of Aug. 5, 2002, which designated the United States of America and which claims priority on German Patent Application number DE 101 40 331.3 filed Aug. 16, 2001, the entire contents of which are hereby incorporated herein by reference.

FIELD OF THE INVENTION

The invention generally relates to an illuminated sign for traffic control, in particular for road traffic. It further generally relates to a method for functional monitoring of such a sign.

BACKGROUND OF THE INVENTION

Signs of widely differing types and importance are generally used for controlling traffic, in order to assist the smooth handling of the traffic. This applies to marine navigation, to aircraft, for example to airports, as well as to all rail traffic, but in particular to road traffic.

Owing to the continuously rising amount of traffic, ever more traffic signs and illuminated signs are used for controlling traffic within cities and for controlling long-distance traffic. An increasing proportion of these signs are produced by light sources. Typical examples of this are the changing illuminated signs for light signaling systems at roadway crossings and the changing traffic signs at so-called freeway intersections.

At the moment, incandescent lamps are primarily used as the light sources for illuminated signs such as these. Incandescent lamps can fail by a short or discontinuity, thus resulting in a sign to be produced by them becoming distorted, with inadequate light intensity or not being displayed at all.

In order to prevent an incorrectly displayed illuminated sign from confusing those in the traffic, it must be switched off immediately in order to avoid a risk of accidents. In order to make it possible to check the availability of a safety-relevant sign, for example a red traffic light, a speed limit or a warning display, even when it is switched off, the monitoring must take place all the time. Thus, the monitoring must take place even when the corresponding sign is not active, that is to say when it is not actually illuminated.

Functional monitoring of the incandescent lamps that produce a sign can be carried out by passing a current through their filaments. The inertia of a filament refers to the fact that the serviceability of the incandescent lamp can be tested by passing a current through the filament for a short time, for example for 1 ms, without any light emerging.

The article "On-board multiplexing system checks car's lights automatically" on pages 68 and 70 of Electronics International may be cited as a reference for a cold lamp test such as this for automatically checking a car lighting system. In this case, commands to activate the lamps are passed via a microprocessor, the signals of the lamps and sensors are monitored, and the driver is informed of any malfunction via a display on the dashboard. A power transistor connects the lighting system to the car battery. A high-impedance voltage divider is connected in parallel with this, and its center potential is used as a criterion for checking a lamp state.

During operation, the microprocessor checks the value of the center potential of the voltage divider every 10 ms. When a light is switched on, the potential is 12 V and when it is off, the potential is 0 V. In the event of a short in the lamp circuit, the potential is, however, 0 V in both cases.

In order to obtain a positive indication for all possible faults and light operating modes, the test must be extended in order also to include the OFF mode when the light is switched on the ON mode when the light is switched off. A switched-on lamp is switched off for about 100 ms once every second by the system; when it is off, the system switches it on periodically for 100 ms every 40 seconds. The tests starts when the engine is started, and ends 100 s after the engine is stopped. This extended operation ensures that lamp failures are detected even during the period when the filament is cooling down.

Incandescent lamps are now increasingly being replaced by light-emitting diodes, which are also referred to in the following text for short as LEDs. This is being done since, as a low-maintenance and high-availability light source for optical signs, LEDs have many advantages for economic operation of light signaling systems.

One problem is that signs which can be produced by LEDs have until now been capable of being monitored only when they are in the switched-on state. It has therefore not been possible to use LED technology for safety-relevant signs, whose serviceability must also be monitored when they are switched off.

Owing to the effectively inertia-free conversion of current to light in LED light sources, a functional test analogous to the so-called cold lamp test was not feasible without production of disturbing, and thus unacceptable, light flashes. In complete darkness, when an LED is operated at its rated current, even pulses with a length of more than about 0.3 μs and with a continuous current of more than about 5 μA are noticeable in a disturbing manner, largely independently of the repetition rate. Signs with functional monitoring which produce sufficiently short and weak current pulses and can reliably monitor them have not until now been feasible at an acceptable complexity level.

SUMMARY OF THE INVENTION

An embodiment of the invention is thus based on an object of providing an illuminated sign as well as a method for functional monitoring of a sign, such that the serviceability of the sign can be monitored both when it is switched on and when it is switched off, with an acceptable technical complexity level.

One part of the object according to an embodiment of the invention is achieved by an illuminated sign. By limiting the current through the light-emitting diodes that is built up after the light source has been switched on, on the basis of the time duration or level, the light emission which occurs directly from the LEDs can be restricted such that it is no longer perceptible for a viewer, even in darkness. This avoids light flashes that would disturb those in the traffic. The rise in the current through the light-emitting diodes is used as the serviceability criterion.

In one preferred refinement of an embodiment of the invention, the monitoring device for the illuminated sign has a switching device for switching off the current flow, once it has been switched on, when the current level reaches a predetermined threshold value. The electrical current flowing through the light-emitting diodes is in this case limited by presetting a maximum threshold value at which the LED current level once it is switched off has been built up. Parts of the existing current monitoring device from the incandescent lamp technology can advantageously be used for the circuitry implementation of this form of current regulation, thus minimizing the circuit cost.

In one advantageous embodiment of the invention, the switching devices are in the form of a digital logic circuit with a memory element. The LED current limiting can therefore be achieved, for example, by using a D-flipflop as the memory element, and by means of further standard components from semiconductor circuit technology.

In one preferred embodiment of the invention, the monitoring device is also designed to measure the voltage which is dropped across light-emitting diodes when current is flowing through them. This separate additional monitoring of the voltage makes it possible to detect a failed light-emitting diode despite the LED current flow, for example in the event of a short. This improves the reliability of the functional testing of an illuminated sign according to an embodiment of the invention.

In other advantageous embodiments, the light sources are arranged as a chain of series-connected light-emitting diodes or as a cluster of light-emitting diodes which are connected to one another. This is advantageously used in an embodiment of illuminated signs with symbols in the form of lines, or flat structures.

Illuminated signs according to an embodiment of the invention and with functional monitoring can preferably be used for traffic signs, in particular for those signs with the option of alternately displaying different signs, or for light signaling systems, that is to say for the generally known traffic lights.

Another object element is achieved by a method of an embodiment of the invention. Since the current flow through the light-emitting diodes is first of all switched on, a current monitoring signal which represents the current level through the light-emitting diodes is generated and, upon reaching a predetermined threshold value for the current monitoring signal, the current flow is switched off again, the light sources in the illuminated sign, which are in the form of light-emitting diodes, have a limited amount of current flowing through them during functional monitoring, such that the only light which is emitted is no longer perceptible by a viewer.

In one preferred embodiment of the method according to the invention, a voltage monitoring signal which represents the voltage that is dropped across the light-emitting diodes through which a current is flowing is also generated. The voltage monitoring signal is used as an additional criterion for assessing the serviceability of a light-emitting diode, in order to make it possible to exclude a short when there is a positive LED current flow.

In one advantageous refinement of the method according to an embodiment of the invention, the current flows when the light-emitting diodes are in an inactive state, or periodically in an inactive phase. This allows the functional monitoring to be carried out not only when the illuminated sign is not in operation—even for a lengthy time period of several months—but also during operation, by switching off the regular LED current flow periodically for a short phase, in which the even shorter test current flow then takes place.

BRIEF DESCRIPTION OF THE DRAWINGS

Further advantages, features and details of the invention will become evident from the description of illustrated embodiments given hereinbelow and the accompanying drawings, which are given by way of illustration only and thus are not limitative of the present invention, wherein.

DETAILED DESCRIPTION OF THE PREFERRED EMBODIMENTS

An illuminated sign according to an embodiment of the invention, for example a changing traffic sign for displaying different traffic signs alternately, is produced, for example, in an outdoor system which is in the form of a display gantry above roadways. The outdoor system has a mains connection for supplying voltage to the LED chains. For this purpose, a commercially available industrial switched-mode power supply, for a DC voltage of 48 V and having an input rating of 100 W, is used. This is connected via a CAN bus to a roadway section station which includes a modem as well as a control and a master module.

By way of example, 32 LED chains, subdivided into four groups of eight each, can be driven via a common drive assembly. The drive assembly contains a digital part and an analog part. The digital part has modules for initialization, assembly identification, read/write logic, a test register, the enabling logic for the normal mode and the test mode, the LED current setting as well as the current and voltage monitoring, while the 32 LED current regulators form the analog part. Up to 8 such drive assemblies can be connected to a common control unit, and they are controlled via a processor module which runs a stored program in order to drive and monitor the LED chains.

Figure 1:
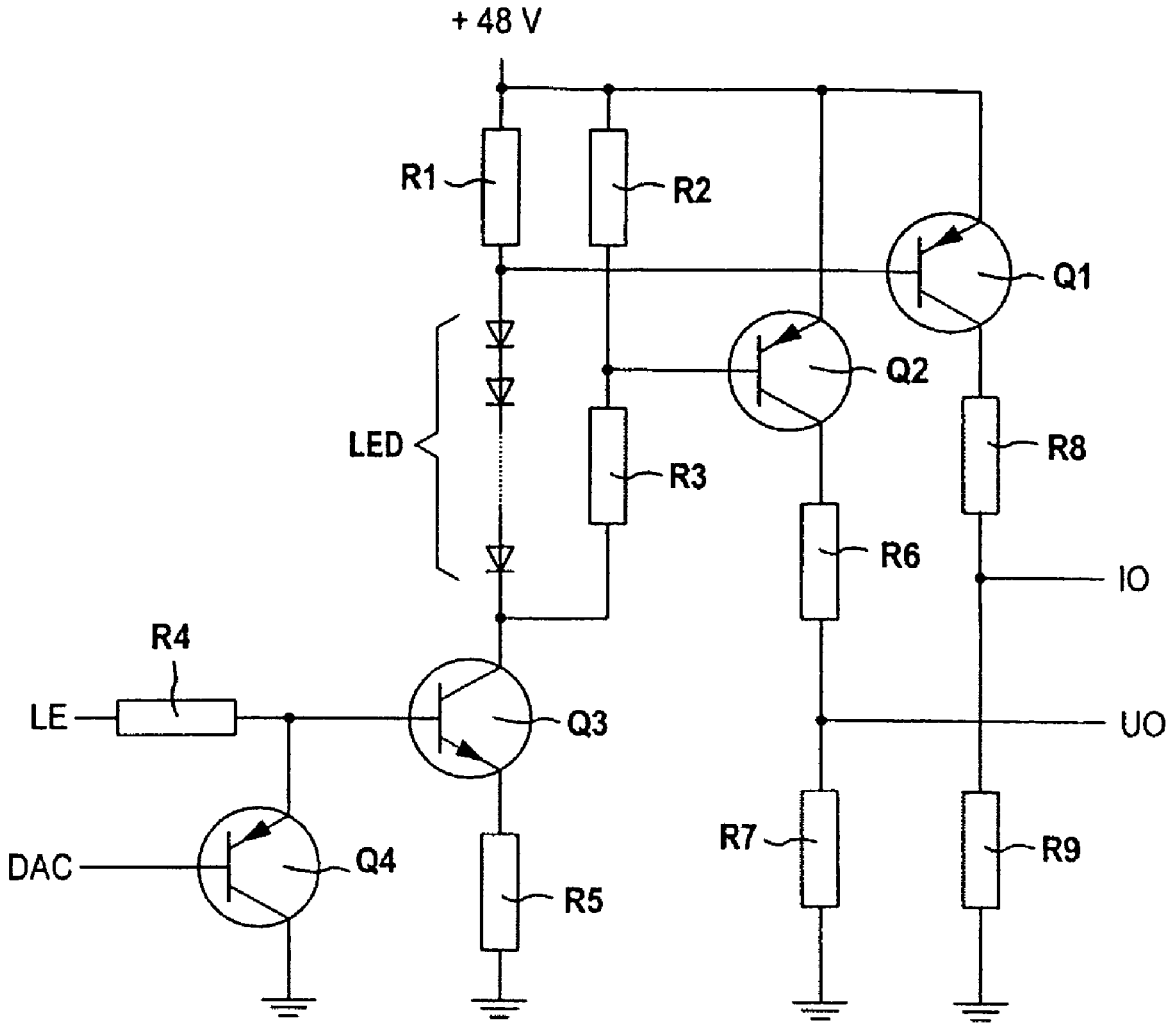
FIG. 1 shows, schematically, a circuit for current regulation in an illuminated sign according to an embodiment of the invention.

In a changing traffic sign for use on federal freeways, a light-emitting diode chain includes, for example, 11 to 19 series-connected light-emitting diodes LED. Each LED chain is driven, as is shown in FIG. 1, by a transistor Q3 which is connected as a current source. The reference variable for the current level is the output voltage from a digital/analog converter DAC, which is connected to the base of the transistor Q3 via a transistor Q4.

When a positive drive signal is present in the LED switch-on signal LE, a collector current which corresponds approximately to the quotient of the voltage from the converter DAC and the resistance R5 is produced after a circuitry-dependent delay time of approximately 1 μs in the transistor Q3. This constant current flows, minus a small parallel current flowing through the resistances R2 and R3, as the operating current through the LED chain. The chain current itself produces a voltage drop in a resistance R1 which is connected upstream of the LED chain and, on reaching the collector/emitter threshold of a transistor Q1, switches this transistor on and generates the current monitoring signal IO.

A transistor Q2 is also driven via resistances R2 and R3 when the voltage drop across the LED chain reaches a value which is set by the voltage divider ratio of R2 to R3, and a voltage monitoring signal UO is thus generated via the transistor Q2. Resistances R6 and R7 as well as R8 and R9 are in this case used for signal conversion to TTL levels.

The monitoring signals IO and UO are stored in the drive assembly and are signaled back to the control unit, where they are processed. The current monitoring is carried out using a standard, fixed threshold for all of the chains: the current sensor output indicates "OFF" when the chain current is less than 4 mA, and indicates "ON" when it is greater than 7 mA. The voltage monitoring for all of the LED chains is likewise carried out using a standard, fixed threshold.

In the test mode, all of the LED chains are checked cyclically, and current faults are found within 10 s. In the normal and test modes, an LED chain is deduced to have failed when the preset nominal value for the voltage indicates "ON" and the measured actual sensor value for the current level indicates "OFF" at the same time. A current fault does not lead to switching off unless a sign which is required at that time can no longer be identified as being able to be displayed. A sign is regarded as no longer capable of being displayed when the number of faulty LED chains exceeds the supplied limit.

Figure 2:
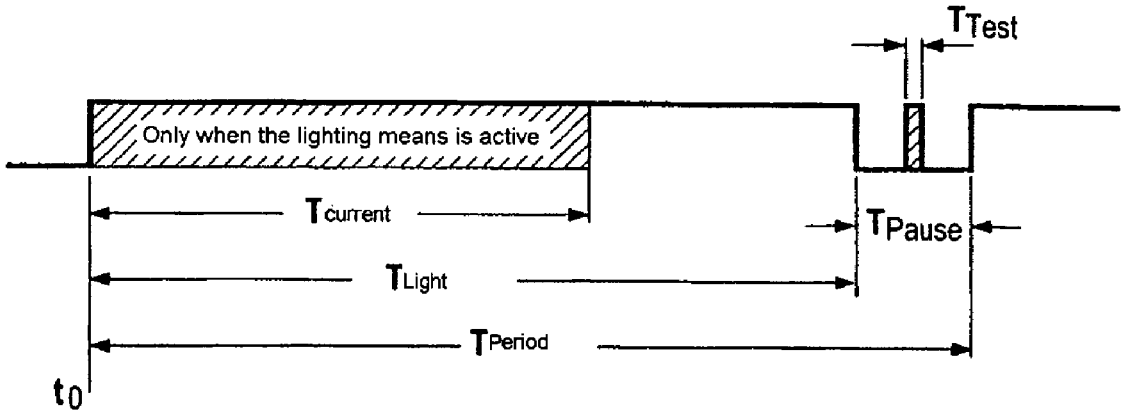
FIG. 2 shows, schematically, the time periods of an LED drive signal.

The LED drive signal when the light source is active is built up periodically as shown in FIG. 2 with a period duration $T_{period}$ of, for example, 10.0 ms. A period starts at the starting point to and is subdivided into an illuminated time $T_{Light}$, that is to say the maximum LED current flow time of, for example 9.0 ms, and a test time $T_{Pause}$ of, for example, 1.0 ms. The illuminated time $T_{Light}$ is composed of the actual current-flow time $T_{current}$, which is approximately 0.1 to 1.0 times the illuminated time $T_{Light}$ for dimming as a function of the environmental brightness. The test pulse $T_{Test}$, which has a maximum duration of 0.3 μs, is produced for functional monitoring of the LED chain during the test time $T_{Pause}$.

In this case, the pulse length ensures that the LED current flow does not result in any disturbing light emission to any of those involved in the traffic. The test pulse $T_{Test}$ may, of course, be produced not only in a periodic interruption in the illuminated time $T_{Light}$, but also in a longer-lasting inactive state of the light source, in order that the availability of the illuminated sign can be checked at any time for a safety-relevant application.

Figure 3:
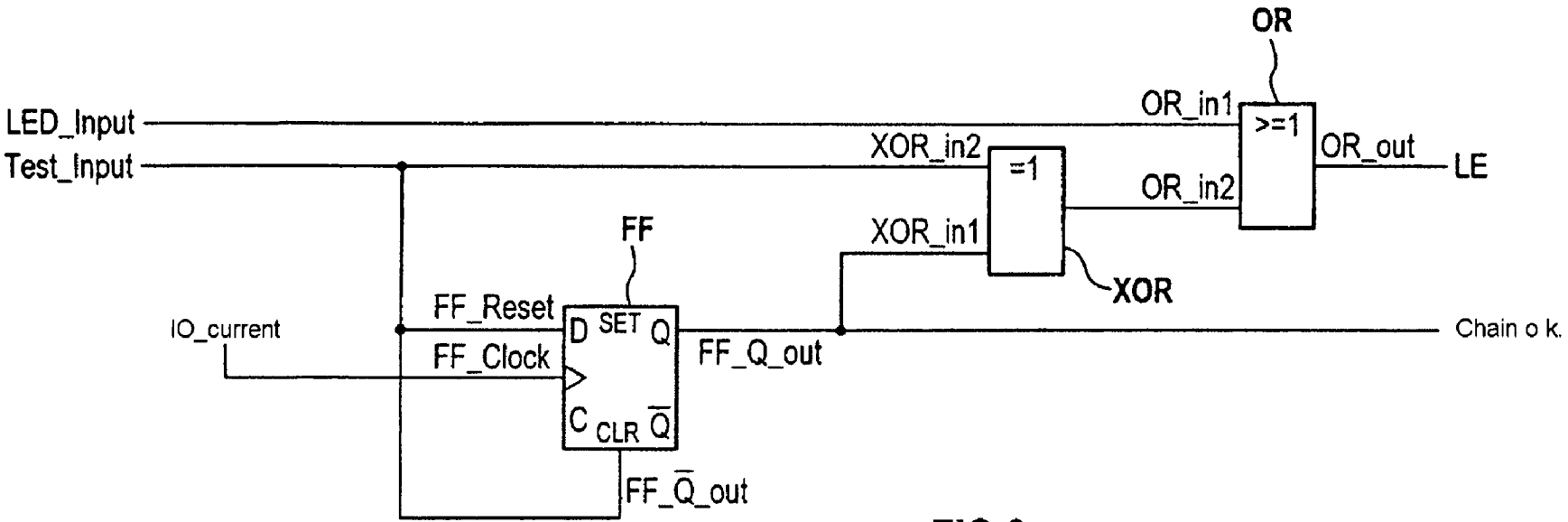
FIG. 3 shows, schematically, the logic circuit as switching means for the monitoring device.

The maximum LED current flow time which is required for the purpose of avoiding visible light flashes is achieved by adding a logic circuit, as shown in FIG. 3, to the current regulator circuit—as described in FIG. 1. The LED switch-on signal LE is controlled via the output OR_out of an OR gate OR, for example of the 74HC32 type.

In the case of a regular LED current flow, the input OR_in1 is equal to 1, and the output OR_out is thus likewise 1. In the test mode, the LED input OR_in1 is equal to 0, and the test input is equal to 1. This is applied to one input XOR_in2 of an EXOR gate XOR, for example of the 74HC86 type. The state at the other input XOR_in1 is initially 0, so that the output XOR out assumes the value 1 owing to the different input states. The output XOR_out is connected to the second input OR_in2 of the OR gate OR, which thus likewise assumes the value 1.

In consequence, OR_out is equal to 1, so that the LED test current flow is switched on. The input XOR_in1 is connected to the output FF_Q_out of a clock-state-controlled D flipflop FF, for example of the 74HC74 type, to whose D input FF_Reset the signal of the test input is applied, that is to say the value 1.

The flipflop FF does not react to the initial state until the clock variable at the C input FF_Clock assumes the value 1. This is the case when the current monitoring IO produces the value 1, that is to say the LED current level has exceeded the predetermined threshold value. The Q output FF_Q_out of the flipflop FF will now assume the value 1, and, in a corresponding manner, $\overline{Q}$ will assume the value 0. On the one hand, this results in the input state at XOR_in1 changing from 0 to 1, which leads to an output state XOR_out of 0; via the OR gate, this switches off the LED current flow. On the other hand, FF_Q_out equal to 1 signals that the LED chain is serviceable.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sign for traffic control, comprising:

light sources, including light-emitting diodes, for production of light to illuminate the sign; and a monitoring device for functional monitoring of the light sources, wherein the monitoring device is designed to produce a limited monitoring current flow through the light-emitting diodes that restricts light emission from the light-emitting diodes in a manner not perceptible by a viewer of the sign, the monitoring device including switching means for switching off the monitoring current flow when a current level reaches a predetermined threshold value.

2. The sign as claimed in claim 1, wherein the switching means include a digital logic circuit with a memory element.

3. The sign as claimed in claim 2, wherein the monitoring device is further designed to measure voltage drop across light-emitting diodes through which a current is being passed.

4. The sign as claimed in claim 3, wherein the light sources are arranged as a chain of series-connected light-emitting diodes.

5. The sign as claimed in claim 1, wherein the monitoring device is further designed to measure voltage drop across light-emitting diodes through which a current is being passed.

6. The sign as claimed in claim 5, wherein the light sources are arranged as a chain of series-connected light-emitting diodes.

7. The sign as claimed in claim 1, wherein the light sources are arranged as a chain of series-connected light-emitting diodes.

8. The sign as claimed in claim 1, wherein the light sources are arranged as a cluster of light-emitting diodes connected to one another.

9. A traffic sign for alternately displaying different signs, including the sign as claimed in claim 1.

10. A light signaling system including the sign as claimed in claim 1.

11. The sign as claimed in claim 1, wherein the illuminated sign is for road traffic control.

12. A traffic light including the sign as claimed in claim 1.

13. A method for functional monitoring of a sign for traffic control including light-emitting diodes to produce light to illuminate the sign, comprising:

switching on current flow through the light-emitting diodes by generating a current monitoring signal, representing current level through the light-emitting diodes; and switching off the current flow when the current monitoring signal reaches a predetermined threshold value; wherein the current flow through the light-emitting diodes causes light emissions not perceptible by a viewer.

14. The method as claimed in claim 13, further comprising:

generating a voltage monitoring signal, representing the voltage dropped across the light-emitting diodes through which a current is flowing.

15. The method as claimed in claim 14, wherein the current flows at least one of when the light-emitting diodes are in an inactive state, and periodically when the light-emitting diodes are in an inactive phase.

16. The method as claimed in claim 13, wherein the current flows at least one of when the light-emitting diodes are in an inactive state, and periodically when the light-emitting diodes are in an inactive phase.

17. A monitoring method for a traffic control sign, including light-emitting diodes adapted to produce light to illuminate the sign, comprising:

generating a current monitoring signal, representing current level through the light-emitting diodes, that permits limited current flow through the light-emitting diodes producing non-perceptible emissions by the light-emitting diodes; and controlling a switching off of the current flow when the current monitoring signal reaches a predetermined threshold value.

18. The method as claimed in claim 17, further comprising:

generating a voltage monitoring signal, representing the voltage dropped across the light-emitting diodes through which a current is flowing.

19. The method as claimed in claim 18, wherein the current flows at least one of when the light-emitting diodes are in an inactive state, and periodically when the light-emitting diodes are in an inactive phase.

20. A device for a sign for traffic control, including light-emitting diodes adapted to produce light to illuminate the sign, comprising:

means for generating a current monitoring signal, representing current level through the light-emitting diodes, that permits limited current flow through the light-emitting diodes producing non-perceptible emissions by the light-emitting diodes; and means for controlling a switching off of the current flow when the current monitoring signal reaches a predetermined threshold value.

21. The sign as claimed in claim 20, wherein the means for controlling a switching off includes a digital logic circuit with a memory element.

22. The sign as claimed in claim 20, wherein the means for generating a current monitoring signal further for measuring voltage drop across light-emitting diodes through which a current is being passed.

23. The sign as claimed in claim 20, wherein the light-emitting diodes are arranged as a chain of series-connected light-emitting diodes.

24. The sign as claimed in claim 20, wherein the light-emitting diodes are arranged as a cluster of light-emitting diodes connected to one another.

25. A traffic sign for alternately displaying different signs, including the sign as claimed in claim 20.

26. A light signaling system including the sign as claimed in claim 20.

27. A sign for traffic control, comprising:

means, including a plurality of light-emitting diodes, for producing light to illuminate the sign; and means for producing a limited monitoring current flow through the light-emitting diodes that restricts light emission from the light-emitting diodes in a manner not perceivable by a viewer of the sign, the means for producing including switching means for switching off the current flow when a current level reaches a predetermined threshold value, wherein said limited monitoring current flow is for functional monitoring of the LEDs.

28. The sign as claimed in claim 27, wherein the means for producing a limited current flow includes a digital logic circuit with a memory element.

29. The sign as claimed in claim 27, wherein the means for producing a limited current flow is further for measuring voltage drop across light-emitting diodes through which a current is being passed.

30. The sign as claimed in claim 27, wherein the light-emitting diodes are arranged as a chain of series-connected light-emitting diodes.

31. The sign as claimed in claim 27, wherein the light-emitting diodes are arranged as a cluster of light-emitting diodes connected to one another.

32. A traffic sign for alternately displaying different signs, including the sign as claimed in claim 27.

33. A light signaling system including the sign as claimed in claim 27.

* * * * *